US010577682B2

(12) United States Patent
Hanlon et al.

(10) Patent No.: US 10,577,682 B2
(45) Date of Patent: Mar. 3, 2020

(54) STEEL STRIP HAVING HIGH STRENGTH AND HIGH FORMABILITY, THE STEEL STRIP HAVING A HOT DIP ZINC BASED COATING

(71) Applicant: TATA STEEL IJMUIDEN B.V., Velsen-Noord (NL)

(72) Inventors: David Neal Hanlon, Hillegom (NL); Marga Josina Zuijderwijk, Haarlem (NL); Stefanus Matheus Cornelis Van Bohemen, Haarlem (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 168 days.

(21) Appl. No.: 15/312,929

(22) PCT Filed: Jul. 6, 2015

(86) PCT No.: PCT/EP2015/025044
§ 371 (c)(1),
(2) Date: Nov. 21, 2016

(87) PCT Pub. No.: WO2016/005061
PCT Pub. Date: Jan. 14, 2016

(65) Prior Publication Data

US 2017/0191150 A1 Jul. 6, 2017

(30) Foreign Application Priority Data

Jul. 7, 2014 (EP) ..... 14176008

(51) Int. Cl.

| | |
|---|---|
| ***C21D 9/46*** | (2006.01) |
| ***C22C 18/02*** | (2006.01) |
| ***C22C 38/04*** | (2006.01) |
| ***C22C 38/38*** | (2006.01) |
| ***C23C 2/06*** | (2006.01) |
| ***C23C 2/40*** | (2006.01) |
| ***C22C 18/00*** | (2006.01) |
| ***C22C 38/06*** | (2006.01) |
| ***C22C 38/02*** | (2006.01) |
| ***C23C 2/02*** | (2006.01) |

(52) U.S. Cl.
CPC ..... *C22C 38/04* (2013.01); *C21D 9/46* (2013.01); *C22C 18/00* (2013.01); *C22C 18/02* (2013.01); *C22C 38/02* (2013.01); *C22C 38/06* (2013.01); *C22C 38/38* (2013.01); *C23C 2/02* (2013.01); *C23C 2/06* (2013.01); *C23C 2/40* (2013.01)

(58) Field of Classification Search
None
See application file for complete search history.

(56) References Cited

U.S. PATENT DOCUMENTS

| | | | | |
|---|---|---|---|---|
| 4,812,371 | A * | 3/1989 | Shindou | C23C 2/06 420/514 |
| 2013/0284321 | A1 | 10/2013 | Bocharova et al. | |
| 2014/0170439 | A1* | 6/2014 | Allain | C21D 1/20 428/659 |
| 2014/0287263 | A1 | 9/2014 | Kawata et al. | |

FOREIGN PATENT DOCUMENTS

| | | | |
|---|---|---|---|
| CN | 101027421 | A | 8/2007 |
| CN | 103874776 | A | 6/2014 |
| DE | 19610675 | C1 | 2/1997 |
| EP | 1354970 | A1 | 10/2003 |
| EP | 1431406 | A1 | 6/2004 |
| JP | H05295433 | A | 11/1993 |
| JP | 2004018971 | A | 1/2004 |
| JP | 2008102009 | A | 5/2008 |
| JP | 2010059452 | A | 3/2010 |
| WO | 2012022184 | A1 | 2/2012 |

OTHER PUBLICATIONS

Machine-English translation of JP 2010-059452, Matsuda Hideka et al., Mar. 18, 2010.*
International Search Report and Written Opinion dated Dec. 9, 2015 for PCT/EP2015/025044 to Tata Steel Ijmuiden B.V. filed Jul. 6, 2015.
Notification of Transmittal of the International Preliminary Report on Patentability dated Jun. 7, 2016 from International Application PCT/EP2015/025044 to Tata Steel Ijmuiden B.V. filed Jul. 6, 2015.
S.M.C. Van Bohemen, The nonlinear lattice expansion of iron alloys in the range 100-1600 K, Scripta Materialia, 2013, vol. 69, pp. 315-318.
S.M.C. Van Bohemen, Austenite in multiphase microstructures quantified by analysis of thermal expansion, Scripta Materialia, 2014, vol. 75, pp. 22-25.
S.M.C. Van Bohemen, Bainite and martensite start temperature calculated with exponential carbon dependence, Materials Science and Technology, 2012, vol. 28, No. 4, pp. 487-495.

* cited by examiner

*Primary Examiner* — Colin W. Slifka
(74) *Attorney, Agent, or Firm* — Vorys, Sater, Seymour and Pease LLP

(57) ABSTRACT

A steel strip having a hot dip zinc based coating, the steel strip having the following composition, in weight %:

C: 0.17-0.24
Mn: 1.8-2.5
Si: 0.65-1.25
Al: ≤0.3
optionally: Nb: ≤0.1 and/or V: ≤0.3 and/or Ti: ≤0.15 and/or Cr: ≤0.5 and/or Mo: ≤0.3,
the remainder being iron and unavoidable impurities;

with a Si/Mn ratio ≤0.5 and a Si/C ratio ≥3.0, with an Mn equivalent ME of at most 3.5, wherein ME=Mn+Cr+2 Mo (in wt. %); having a microstructure with (in vol. %): ferrite: 0-40, bainite: 20-70, martensite: 7-30, retained austenite: 5-20, pearlite: ≤2, cementite: ≤1; having a tensile strength in the range of 960-1100 MPa, a yield strength of at least 500 MPa, and a uniform elongation of at least 12%.

20 Claims, No Drawings

STEEL STRIP HAVING HIGH STRENGTH AND HIGH FORMABILITY, THE STEEL STRIP HAVING A HOT DIP ZINC BASED COATING

CROSS-REFERENCE TO RELATED APPLICATIONS

This is a § 371 National Stage Application of International Application No. PCT/EP2015/025044 filed on Jul. 6, 2015, claiming the priority of European Patent Application No. 14176008.2 filed on Jul. 7, 2014.

The present invention relates to a steel strip having high strength and high formability, which steel strip is provided with a hot dipped zinc based coating, such as used in the automotive industry, as well as to a manufacturing method thereof.

Steel strips having balanced properties regarding strength and formability are known in the art. Nevertheless there is an ongoing search for and development of steel types, of which the single properties and/or balance of properties is improved.

The present invention is directed to a steel strip having a tensile strength in the range of 960-1100 MPa, a yield strength of at least 500 MPa and a uniform elongation of at least 12% as a set of balanced properties. Steel strips having such a set of balanced properties have the potential of realising weight reduction in e.g. automotive industry without impairing other properties.

Steel strips with a comparable balance of properties are known and can be produced on continuous lines, however without galvanic protection. Therefore the applicability of these steel strips is limited to those applications which do not require such galvanic protection, e.g. seats and interior parts in automotive applications. For many of these applications the strength and formability properties suffice.

Complex shaped parts for automotive applications in the body-in-white require enhanced (cold) formability at (ultra) high strength to allow down gauging. Weight reduction by down gauging is important to meet increasing demands of environmental legislation. In addition, in order to ensure an acceptable service life of these body-in-white applications galvanic protection is required.

At present products meeting these requirements of formability, strength and galvanic protection are manufactured in a process comprising separated process steps. In a first step a steel strip is subjected to continuous annealing on a continuous annealing line. Subsequently the steel strip thus produced is coated off-line in a separate step using a conventional electro galvanising technology. However, electro galvanising of high and ultrahigh strength steel strip has the inevitable risk of delayed fracture due to hydrogen embrittlement, caused by liberation of hydrogen ions during electroplating and charging of the steel strip with hydrogen ions.

Alternative cold-coating technologies like PVD, avoiding the risk of hydrogen embrittlement, remain unproven for commercial production of large volumes of commodity steels. Therefore hot dip galvanising is still preferred over electro galvanising and alternative cold-coating technologies.

Recently is has been shown that steel compositions having a so-called "rich" chemistry can be manufactured such that they can be subjected to a hot dip galvanisation treatment. However, these compositions require a careful control of the oxidation state of the surface during heat treatment steps through careful and precise control of the furnace atmosphere involving a high capital investment in suitable control and processing equipment. Typically such a manufacturing line is also used for manufacturing other steel product. Therefore the outcome of the process for the whole product portfolio of the production line in question is affected. As the rich chemistry products are only manufactured in a low volume compared to high volume commodity products the capital investment is a disadvantage. Also from a metallurgical point of view these steel compositions having a rich chemistry suffer from the drawback that promoting the internal oxidation of sensitive elements may lead to the formation of brittle oxides in the near surface region, possibly resulting in loss of ductility, degradation of properties like bendability and deterioration of surface quality, finally resulting in a reduction of the number or types of applications where these steel products can be used.

In galvanising, the addition of rare-earth elements to either the substrate or the zinc bath is known to improve wettability of liquid zinc. These rare-earth elements are expensive and in increasingly short supply.

Separation of the annealing step and the HDG step involves additional costs and increases the logistic complexity. Moreover, reheating to the appropriate temperature for the HDG treatment often leads to unacceptable degradation of the strip properties.

The invention aims at providing a steel strip having a high formability, represented by a yield strength of at least 500 MPa and a uniform elongation of at least 12%, at high strength in the range of 960-1100 MPa and having an adherent, continuous, galvanic protection layer that can be applied in a continuous process using a single manufacturing line, without the abovementioned drawbacks of the composition of the steel substrate and/or zinc bath, of separating the annealing and coating steps into different processing lines, or at least to a lesser extent.

According to a first aspect of the invention a steel strip having a hot dip zinc based coating is provided, the steel strip having the following composition, in weight %:

C: 0.17-0.24
Mn: 1.8-2.5
Si: 0.65-1.25
Al: ≤0.3
optionally:
Nb: ≤0.1 and/or V: ≤0.3 and/or Ti: ≤0.15 and/or Cr: ≤0.5 and/or Mo: ≤0.3,
the remainder being iron and unavoidable impurities,
with a Si/Mn ratio ≤0.5 and a Si/C ratio ≥3.0,
with an Mn equivalent ME of at most 3.5, wherein ME=Mn+Cr+2 Mo (in wt. %)
having a microstructure with (in vol. %):
ferrite: 0-40
bainite: 20-70
martensite: 7-30
retained austenite: 5-20
pearlite: ≤2
cementite: ≤1
having a tensile strength in the range of 960-1100 MPa, a yield strength of at least 500 MPa, and a uniform elongation of at least 12%.

It has been found that a steel strip having a composition and a microstructure as defined above and also having a zinc based coating meets the above aim regarding the balanced mechanical properties of the strip and the galvanic protection layer, without the need of thoroughly modifying the production line in terms of annealing steps, furnace atmosphere and control equipment, the galvanising technology and without the need of introducing scarcely available elements in the composition of the substrate and/or the zinc bath.

According to a second aspect the invention provides a method for producing a high strength hot dipped zinc coated steel strip in a continuous way, comprising the following steps:

1) providing a steel strip having the following composition in wt. %:
   C: 0.17-0.24
   Mn: 1.8-2.5
   Si: 0.65-1.25
   Al: ≤0.3
   optionally:
   Nb: ≤0.1 and/or V: ≤0.3 and/or Ti: ≤0.15 and/or Cr: ≤0.5 and/or Mo: ≤0.3
   the remainder being iron and unavoidable impurities,
   with a Si/Mn ratio ≤0.5 and a Si/C ratio ≥3.0,
   with an Mn equivalent ME of at most 3.5, wherein ME=Mn+Cr+2 Mo (in wt. %):
2) heating the strip to a temperature T1 (in ° C.) in the range of (Ac3+20)-(Ac3−30) to form a fully or partially austenitic microstructure:
3) slow cooling of the strip with a cooling rate in the range of 2-4° C./s to a temperature T2 in the range of 620-680° C.;
4) rapid cooling of the strip with a cooling rate in the range of 25-50° C./s to a temperature T3 (in ° C.) in the range of (Ms−20)-(Ms+100);
5) keeping the strip at a hold or slow cool temperature T4 in the range of 420-550° C. for a time period of 30-220 seconds;
6) hot dip coating the steel strip in a zinc bath to provide the strip with a zinc based coating;
7) cooling the coated steel strip at a cooling rate of at least 5° C./s to a temperature below 300° C.

The invention entails balancing the alloy content of the steel composition such as to balance the transformation behaviour against the cooling capabilities of typical (conventional) annealing lines and to control the rate of diffusion of essential elements to the surface during heating and soaking and in turn to retard the development of a deleterious surface oxidation state prior to entry into the zinc bath. Basically the microstructure and control of surface oxidation is achieved by the composition, in other words by balancing the relative and absolute content of the chemical elements. As such the chemical elements of the present composition are well known elements utilised in conventional steels.

Regarding the mechanical properties a tensile strength of 960-1100 MPa offers the abovementioned down gauging and down weighting potential. A yield strength of at least 500 MPa prior to temper rolling allows to minimise strength differential in final parts after shaping, offers acceptable levels of springback and provides a practical compromise between ductility and stretched edge ductility.

With Respect to the Composition of the Steel Strip the Following Details are Presented.

Carbon: 0.17-0.24 wt. %. Carbon serves to deliver strength and to enable the stabilisation of retained austenite. Carbon content is preferably 0.18-0.22 wt. % in view of upstream processability and spot weldability. For optimal properties a C content of equal to or more than 0.20 wt. % in this range is more preferred. Below this range the level of free carbon may be insufficient to enable stabilisation of the desired fraction of austenite. As a result the desired level of ductility and/or uniform elongation may not be achieved. Above this range, processability on conventional manufacturing lines and manufacturability at the end user deteriorates. In particular weldability becomes a concern.

Manganese: 1.8-2.50 wt. %. Like carbon, manganese has the function of strengthening. Manganese is also important regarding retardation of ferrite formation and suppression of transformation temperatures such that a fine and homogeneous bainitic phase is readily formed during arrested cooling in the isothermal $5^{th}$ step, which is important for attaining the final properties. Above the upper limit of 2.50 wt. % the wettability of a steel strip having this composition is impaired. At a Mn content below the lower limit of 1.8 wt. % strength and transformation behaviour are deteriorated. When the carbon and manganese contents are too high spot weldability may be impaired.

Silicon: 0.65-1.25 wt. %. Similar to Mn silicon ensures sufficient strength and appropriate transformation behaviour. In addition Si suppresses carbide formation due to its very low solubility in cementite, which would otherwise consume carbon required for austenite stabilisation. Carbide formation would also affect ductility and mechanical integrity. In view thereof in the invention the Si/C ratio is more than 3.0, preferably more than 4.0 in view of the processing conditions, in particular the cooling conditions as discussed hereinafter. Preferably Si is in the range of 0.8-1.2 wt. % in view of wettability in combination with suppression of carbide formation and promotion of austenite stabilisation.

The Si/Mn ratio is less than 0.5 in view of controlling the diffusion rate of Si to the surface, thereby keeping the rate of formation of adherent oxides to an acceptable minimum and consequently ensuring wettability of liquid zinc and a high level of adhesion. The Si/Mn ratio also contributes in keeping the generation of unwanted transformation products like pearlite and coarse carbides during primary cooling to an acceptable minimum value. Consequently mechanical properties like tensile ductility, stretched edge ductility and bendability benefit from the balance between silicon and manganese according to said ratio.

Aluminium: at most 0.3 wt. %. The primary function of Al is deoxidising the liquid steel before casting. Furthermore small amounts of Al can be used to adjust the transformation temperatures and kinetics during the cooling arrest. Higher amounts of Al are undesirable, although Al can suppress carbide formation and thereby promote stabilisation of austenite through free carbon. Contrary to Si, it has no significant effect on strengthening. High levels of Al may also lead to elevation of the ferrite to austenite transformation temperature range to levels that are not compatible with conventional installations.

Optionally one or more of the following elements can be contained in the steel composition: Nb≤0.1 (preferably 0.01-0.04 in view of costs, undesirable retardation of recovery/recrystallization and high rolling loads in hot mill), V≤0.3 and/or Ti≤0.15 wt. %. These elements can be used to refine microstructure in the hot rolled intermediate products and the finished products. They also possess a strengthening effect. They have also a positive contribution to optimisation of application depending properties like stretched edge ductility and bendability.

Other optional elements are Cr≤0.5 and/or Mo≤0.3 wt. % in view of strength. The manganese equivalent, calculated as the sum of manganese content (in %), chromium content and two times the molybdenum content (ME=Mn+Cr+2*Mo) should be kept below 3.5, preferably below 3.

The complex microstructure of the final steel strip comprises ferrite, bainite, martensite, retained austenite and optionally small amounts of pearlite and cementite within the limits presented hereinabove. Ferrite, which may be intercritical ferrite or fresh (retransformed) ferrite is essential for providing a formable and work hardenable substrate. A fraction of retransformed ferrite, formed during slow cooling from the annealing temperature, is desirable in those cases where an elevated yield strength is aimed for. Bainite not only provides strength, but the formation thereof is also a prerequisite for retaining austenite. The transformation of bainite in the presence of silicon drives the partition of carbon to the austenite phase, enabling levels of carbon enrichment in the austenite phase allowing formation of a (meta)stable phase at ambient temperature. Bainite has also the advantage over martensite as a strengthening phase that it causes less micro-scale localisation of strain and consequently improves resistance to fracture with respect to dual phase steels. Martensite is formed during the final quench of the annealing and results in suppressing yield point elongation and in increasing the n-value (work hardening component), which is desirable for achieving stable, neck free deformation and strain uniformity in the final pressed part. The lower limit of 7 vol. % of fresh martensite in the final steel strip gives the steel strip a tensile response and thus press behaviour comparable to conventional dual phase steels. The steel strip according to the invention derives its strength from phase strengthening with appropriate fractions of bainitic ferrite and martensite. The metastable retained austenite fraction ensures the balanced combination of strength and ductility properties. Retained austenite enhances ductility partly through the TRIP effect, which manifests itself in an observed increase in uniform elongation. The final properties are also dependent on the interaction between the various phases of the complex microstructure. Here, low levels of carbides and carbidic phases and the presence of both ferrite and bainitic ferrite each contribute to the stabilisation of austenite but also directly to the enhancement of ductility by improving the mechanical integrity and suppressing early void formation and fracture.

Preferably the microstructure comprises (in vol. %)

- intercritical ferrite: up to 30. Above this limit, the final microstructure will not contain enough bainite and/or martensite, and thus strength will be too low.
- retransformed ferrite: up to 40. Above this limit, the final microstructure will not contain enough bainite and/or martensite, and thus strength will be too low.
- bainite: 20-70. Below the lower limit, there will be insufficient austenite stabilization. Beyond the upper limit, insufficient martensite will be present, and thus strength will be too low.
- martensite: 7-30. Below this limit, the DP tensile response (work hardening like a DP steel when strained) is not adequate. Above the upper limit strength will be too high.
- retained austenite: 5-20. Below 5 vol. % the desired level of ductility and/or uniform elongation will not be achieved. The upper limit is set by the composition.

The steel strip has a zinc based coating. Advantageously the zinc based coating is a galvanised or galvannealed coating. The Zn based coating may comprise a Zn alloy containing Al as an alloying element. A preferred zinc bath composition contains 0.10-0.35 wt. % Al, the remainder being zinc and unavoidable impurities. Another preferred Zn bath comprising Mg and Al as main alloying elements, has the composition: 0.5-3.8 wt. % Al, 0.5-3.0 wt % Mg, optionally at most 0.2% of one or more additional elements; the balance being zinc and unavoidable impurities. Additional elements are Pb, Sb, Ti, Ca, Mn, Sn, La, Ce, Cr, Ni, Zr or Bi.

In the continuous method according to the invention in the first step a steel product having the composition as discussed above and the desired strip dimensions is provided as an intermediate for the subsequent annealing and hot dip galvanising steps. Suitably the composition is prepared and cast into a slab. Then the cast slab is processed using hot and cold rolling steps to obtain the desired size of the steel strip, which is subjected to the heat treatment and hot dip coating treatment defined in the further steps. The first step advantageously involves thin slab casting and direct sheet rolling without reheating in order to suppress the formation of liquid silicon oxide formation. Such liquid silicon oxides are detrimental to the rolling loads resulting in a limited dimension window regarding the combinations of width and thickness that can be attained. These oxides may also cause surface contamination problems. Thin slab casting and direct sheet rolling do not suffer from the problems caused by the liquid silicon oxides, resulting in a wider dimension window, improvement of surface conditions and pickleability. However, if reheating is used in step 1, then conventional ovens of the walking beam and pusher type can be used, advantageously in a limited temperature range of 1150-1270° C. in order to restrict the formation of liquid silicon oxides. Typically hot rolling of the slab is performed in 5 to 7 stands to a final dimension that is suitable for further cold rolling. Typically finish rolling is performed in the fully austenitic condition above 800° C., advantageously 850° C. The strip from the hot rolling steps may be coiled, e.g. at a coiling temperature of 580° C. or more, thereby avoiding the transformation to hard products allowing coiling in an essentially austenitic condition. That is to say only a few percent transformation has occurred after 10 seconds on the run-out table. Prior to further cold rolling the hot rolled strip is pickled. Cold rolling is carried out to obtain a steel strip product that is subjected to the heat treatment and coating steps (steps 2 and further) according to the invention. The function of the hot and cold rolling steps is to provide adequate homogeneity, refinement of microstructure, surface condition and dimension window. If casting alone provides these desired features, then hot and/or cold rolling could be potentially left out.

In the second step the strip is heated to a temperature T1 (in ° C.) in the range of (Ac3+20)-(Ac3−30) to form a fully or partially austenitic microstructure. Next the thus heated strip is slowly cooled to a temperature T2 in the range of 620-680° C. with a cooling rate in the range of 2-4° C./s and then rapidly cooled to a temperature T3 (in ° C.) in the range of (Ms−20)-(Ms+100) at a cooling rate in the range of 25-50° C./s. In the following step the strip is held at a hold or slow cool temperature T4 in the range of 420-550° C. for a time period of 30-200 seconds. During this fifth step the temperature T4 can vary due to radiation losses, latent heat of transformation that occurs, or both. A temperature variation ±20° C. is permissible. Preferably T4 is in the range of 440-480° C. In fact if the method according to the invention is carried out using conventional production lines preferably the isothermal holding time is at most 80 seconds thereby allowing line speeds comparable to and compatible with normal production schedules in view hot dip galvanising, and allowing to fully utilise the design capacity of the production facility. If T3<T4, this step might require reheating from T3 to T4. The next step is the coating step wherein the strip thus heat treated is subjected to hot dip coating in a zinc bath thereby applying an overall zinc based coating to all the exposed surfaces of the strip. Typically the bath temperature is e.g. in the range of 420-440° C. Advantageously the strip temperature upon entry into the zinc bath is at most 30° C. above the bath temperature. After hot dip coating the coated strip is cooled down below 300° C. at a cooling rate of at least 5° C./s. Cooling down to ambient temperature may be forced cooling or uncontrolled natural cooling.

Optionally a temper rolling treatment may be performed with the annealed and zinc coated strip in order to fine tune the tensile properties and modify the surface appearance and roughness depending on the specific requirements resulting from the intended use.

Experiments were performed and the obtained strips were tested. The composition and data relating to the heat treatment steps as well as the mechanical properties are listed in Table 1.

Laboratory melts with a charge weight of 50 kg were prepared in a vacuum oven and ingots of 25 kg were cast. The cast blocks were reheated and roughed, subjected to a hot strip mill rolling and coiling simulation and subsequently cold rolled to a thickness of 1 mm. For determination of mechanical properties strip samples were annealed using a laboratory continuous annealing simulator. For testing of the galvanising properties samples were annealed in a furnace and hot dipped galvanised in a molten metal bath using a Rhesca hot dip process simulator.

Tensile properties were determined using a servohydraulic testing machine in a manner in accordance with ISO 6892.

Hole expansion testing was carried out using the testing method describe in ISO 16630 on samples with punched holes, burr on the upper side away from the conical punch.

A strip (having dimensions of 600 mm×110 mm×1 mm) was prepared as an intermediate product containing the elements in the indicated amounts (mass %). Then the strip was annealed according to the following scheme in the laboratory continuous annealing simulator. First the intermediate strip was heated to a temperature T1 such that a fully austenitic microstructure was obtained. Then the strip was cooled to temperature T2 at a cooling rate of 3° C./s, followed by additional cooling to a temperature T3 at a cooling rate of 32° C./s. Next the strip was held at a temperature T4, in this case equal to T3, for 53 seconds. Then the strip was brought to a temperature of 465° C. and held at this temperature for 12 seconds to simulate the hot dip galvanizing step. The strip was cooled down to 300° C. at a rate of 6° C./s. Thereafter the strip was allowed to cool down further to about 40° C. at a rate of 11° C./s, finally the steel strip was removed.

For hot dip galvanising, samples with dimensions of 200 mm×120 mm×1 mm were wiped clean using a cloth, followed by ultrasonic cleaning for 10 minutes in acetone, and finally cleaned by a cloth with acetone. The thus cleaned sample was annealed according to the annealing cycle described above and hot dip galvanised in a Rhesca hot dip process simulator. The thus heat treated steel strip having a temperature of 470° C. was hot dip galvanised in a zinc bath having a temperature of 465° C. The zinc bath composition was 0.2 wt. % Al, the balance being zinc. The coating thickness was about 10 micrometres. Dipping time in the zinc bath was 2 to 3 seconds.

Surface appearance was evaluated qualitatively by the number and size of bare spots present within the fillet size on the prime side.

Zinc adhesion was evaluated using an adapted version of the BMW test AA-0509. For each lab coated sample, a strip of 30×200 mm was covered with a line of Betamite 1496V glue. The line had a minimum line length of 150 mm and a minimum width of 10 mm and about 5 mm thick. The Betamite glue was then cured in a furnace at 175±3° C. for a period of 30 minutes. The test sample with Betamite on top was bended to 90±5° using a bending apparatus HBM UB7. The adhesion of the coating was evaluated visually.

Further experiments were performed with a small-scale laboratory route utilising ingots of 200-300 g which was applied to generate additional microstructural data. These small-scale ingots were similarly subjected to hot and cold rolling simulations. Table 2 shows a list of the alloys used together with the key transformation temperatures. The last column indicates whether these alloys are inventive or a comparative example.

Table 3 shows, for a number of alloys mentioned in Table 2, process-property combinations for different examples. For a number of alloys, the process parameters are both inside and outside the method features of the invention. Table 3 also shows product features such as Rp and Rm, which are sometimes according to the invention and sometimes not. The right-hand column again shows whether an alloy is inventive in view of the process and product features, or is a comparative example.

In Table 4 a number of inventive examples according to Table 2 is provided, for which the process variants are both inside and outside the method features of the inventions. For these examples, the microstructure is determined. Table 4 clearly shows that the examples are inventive when the process parameters are inside the ranges provided by the invention, as indicated in the right-hand column.

Microstructural data were obtained using cold rolled strip from several sources: full-scale production full-hard samples, cold rolled laboratory feedstock from the 25 kg laboratory route and also cold rolled feedstock derived from small scale laboratory casts. The volume fractions of phases have been evaluated from dilatometry data with the Lever rule (the linear law of mixtures) applied to the data using the non-linear equations for the thermal contraction of bcc and fcc lattices derived in Ref. [1]. For cooling after full austenitisation, T1>Ac3, the measured thermal contraction in the high temperature range where no transformations occur can be simply described by the expression proposed in Ref. [1] for the fcc lattice. For cooling after partial austenitisation, T1<Ac3, the measured thermal contraction in the high temperature range is determined by the coefficients of thermal expansion (CTE) of the individual phase constituents according to a rule of mixtures. Thus the analysis of dilatation data using the expressions developed in Ref. [1] enables the determination of the volume fractions of bcc and fcc phase in a given temperature range provided no phase transformations occur. The start of transformation during cooling is identified by the first deviation of the dilatometry data from the line defined by the thermal expansion in the high temperature range.

After the analysis of the high temperature dilatometry data, the approach discussed in Ref. [2] was used to determine the volume fraction of retained austenite (RA) in annealed dilatometer samples. This fraction specified the relation between the dilatation and the total bcc phase fraction at room temperature. Subsequently, by applying the Lever rule, the fraction of bcc phases could be quantified as a function of temperature between T1 and room temperature. Then, after determining of the fraction curve, fractions of bcc phase formed in a certain temperature ranges could be assigned to ferrite, bainite or martensite using knowledge of the transformation start temperatures of bainite and martensite. These start temperatures were estimated using the empirical formula's proposed in Ref. [3].

Table 5 shows for a number of alloys from Table 2 whether the steel meets the coating criteria. The sheets are preoxidised or not, as indicated. The Mn and Si content of the composition is copied from Table 2, as well as the Si/Mn ratio. In separate columns the coating criteria are indicated. Wetability rating is relative and arrived at by visual comparison with commercial AHSS reference. Adhesion is determined according to adapted BMW test AA-0509. Whether an alloy is inventive or comparative with regard to coatability is indicated in a separate column, and the comments why this is the case are presented in the right-hand column.

Ref [1] S. M. C. Van Bohemen, Scr. Mater. 69 (2013) 315-318.

Ref. [2] S. M. C. Van Bohemen, Scr. Mater. 75 (2014) 22-25.

Ref. [3] S. M. C. van Bohemen, Mater. Sci. and Technol. 28 (2012) 487-495.

TABLE 1

| Ex. | | C (%) | Mn (%) | Si (%) | Si/ Mn | Si/ C | Ac3 (calc; ° C.) | Ms (calc; ° C.) | Bs (calc; ° C.) | T1 (°) | T2 (°) | T3 (°) | T4 (°) | Rp/ Rm | Rp (MPa) | Rm (MPa) | Ag (%) | Zn appear-ance | Zn adher-ence |
|---|---|---|---|---|---|---|---|---|---|---|---|---|---|---|---|---|---|---|---|
| 1A | Comp | 0.22 | 2.4 | 0.6 | 0.26 | 2.81 | 820 | 370 | 559 | 785 | 680 | 470 | 470 | 0.46 | 476 | 1038 | 12 | | |
| 1B | Comp | 0.22 | 2.4 | 0.6 | 0.26 | 2.81 | 820 | 370 | 559 | 810 | 680 | 470 | 470 | 0.58 | 572 | 988 | 11.6 | good | good |
| 2A | Comp | 0.22 | 2.25 | 0.8 | 0.36 | 3.65 | 833 | 370 | 566 | 795 | 680 | 470 | 470 | 0.44 | 446 | 1007 | 14.1 | | |
| 2B | Inv | 0.22 | 2.25 | 0.8 | 0.36 | 3.65 | 833 | 370 | 566 | 820 | 680 | 470 | 470 | 0.59 | 579 | 989 | 12.2 | good | acceptable |
| 3A | Comp | 0.22 | 2.08 | 1 | 0.48 | 4.58 | 845 | 375 | 576 | 805 | 680 | 470 | 470 | 0.43 | 433 | 998 | 13.8 | | |
| 3B | Inv | 0.22 | 2.08 | 1 | 0.48 | 4.58 | 845 | 375 | 576 | 830 | 680 | 470 | 470 | 0.53 | 527 | 991 | 13.5 | good | good |
| 2C | Comp | 0.22 | 2.25 | 0.8 | 0.36 | 3.65 | 833 | 370 | 566 | 795 | 650 | 470 | 470 | 0.45 | 474 | 1061 | 13.9 | | |
| 2D | Inv | 0.22 | 2.25 | 0.8 | 0.36 | 3.65 | 833 | 370 | 566 | 820 | 650 | 470 | 470 | 0.54 | 526 | 978 | 13.9 | na | na |
| 3C | Comp | 0.22 | 2.08 | 1 | 0.48 | 4.58 | 845 | 375 | 576 | 805 | 650 | 470 | 470 | 0.44 | 443 | 1000 | 14.8 | | |
| 3D | Inv | 0.22 | 2.08 | 1 | 0.48 | 4.58 | 845 | 375 | 576 | 830 | 650 | 470 | 470 | 0.57 | 565 | 988 | 13.5 | na | na |
| 4A | Comp | 0.2 | 2.41 | 0.8 | 0.33 | 4.01 | 835 | 377 | 559 | 800 | 680 | 470 | 470 | 0.47 | 520 | 1115 | 11 | | |
| 4B | Comp | 0.2 | 2.41 | 0.8 | 0.33 | 4.01 | 835 | 377 | 559 | 830 | 680 | 470 | 470 | 0.52 | 574 | 1107 | 9.8 | | |
| 4C | Comp | 0.2 | 2.41 | 0.8 | 0.33 | 4.01 | 835 | 377 | 559 | 830 | 620 | 470 | 470 | 0.5 | 555 | 1110 | 9.3 | | |
| 5A | Comp | 0.18 | 2.52 | 0.8 | 0.32 | 4.55 | 839 | 382 | 554 | 805 | 680 | 470 | 470 | 0.52 | 570 | 1097 | 9.9 | | |
| 5B | Comp | 0.18 | 2.52 | 0.8 | 0.32 | 4.55 | 839 | 382 | 554 | 835 | 680 | 470 | 470 | 0.52 | 564 | 1084 | 9.7 | | |
| 5C | Comp | 0.18 | 2.52 | 0.8 | 0.32 | 4.55 | 839 | 382 | 554 | 835 | 620 | 470 | 470 | 0.51 | 566 | 1100 | 9.8 | | |

Comp = comparative example;

Inv = according to the invention

TABLE 2

| Alloy | C wt % | Mn wt % | Si Wt % | Al wt % | V wt % | Nb wt % | Ti wt % | Cr wt % | Mo wt % | Si/ Mn | Si/ C | Mn Equiv. wt % | Ac3 Calc ° C. | Ms Calc ° C. | Bs Calc ° C. | I/C |
|---|---|---|---|---|---|---|---|---|---|---|---|---|---|---|---|---|
| 1 | 0.22 | 2.4 | 0.60 | 0.03 | — | — | — | — | — | 0.26 | 2.81 | 2.4 | 820 | 370 | 559 | C |
| 2 | 0.22 | 2.3 | 0.80 | 0.03 | — | — | — | — | — | 0.35 | 3.65 | 2.3 | 833 | 370 | 566 | I |
| 3 | 0.22 | 2.1 | 1.00 | 0.03 | — | — | — | — | — | 0.48 | 4.58 | 2.3 | 845 | 375 | 576 | I |
| 4 | 0.22 | 1.8 | 0.87 | 0.03 | — | — | — | — | — | 0.48 | 3.95 | 1.8 | 847 | 384 | 596 | I |
| 5 | 0.19 | 2.1 | 1.04 | 0.03 | — | — | — | — | — | 0.50 | 5.50 | 2.1 | 861 | 392 | 589 | I |
| 6 | 0.18 | 1.9 | 1.20 | 0.03 | — | — | — | — | — | 0.63 | 6.86 | 1.9 | 874 | 397 | 590 | C |
| 7 | 0.24 | 2.0 | 1.00 | 0.03 | — | — | — | — | — | 0.49 | 4.26 | 2.0 | 844 | 370 | 569 | I |
| 8 | 0.22 | 2.1 | 0.88 | 0.03 | 0.07 | — | — | — | — | 0.42 | 4.09 | 2.1 | 841 | 374 | 569 | I |
| 9 | 0.22 | 2.1 | 0.99 | 0.03 | — | — | — | — | — | 0.47 | 4.50 | 2.1 | 840 | 375 | 576 | I |
| 10 | 0.20 | 1.7 | 1.53 | 0.03 | — | — | — | — | — | 0.93 | 7.65 | 1.5 | 892 | 390 | 610 | C |
| 11 | 0.20 | 1.5 | 1.44 | 0.03 | — | — | — | — | — | 0.95 | 7.27 | 1.5 | 890 | 396 | 615 | C |
| 12 | 0.2 | 1.5 | 1.40 | 0.03 | — | — | — | — | 0.30 | 0.93 | 7.00 | 1.5 | 896 | 392 | 592 | C |
| 13 | 0.2 | 1.5 | 1.40 | 0.03 | — | — | — | — | — | 0.93 | 7.00 | 1.5 | 890 | 396 | 615 | C |
| 14 | 0.22 | 2.1 | 1.01 | 0.03 | — | — | — | — | — | 0.48 | 4.68 | 2.1 | 845 | 375 | 576 | I |
| 15 | 0.21 | 2.1 | 0.95 | 0.03 | — | — | — | — | — | 0.45 | 4.46 | 2.1 | 845 | 375 | 576 | I |
| 16 | 0.22 | 2.1 | 1.01 | 0.28 | — | — | — | 1.07 | — | 0.48 | 4.59 | 2.1 | 859 | 362 | 495 | C |
| 17 | 0.22 | 2.1 | 1.00 | 0.55 | — | — | — | 1.07 | — | 0.48 | 4.55 | 2.1 | 885 | 363 | 497 | C |
| 18 | 0.23 | 2.1 | 1.01 | 0.55 | — | — | — | 0 | — | 0.49 | 4.39 | 2.1 | 898 | 370 | 568 | C |
| 19 | 0.23 | 2.1 | 1.00 | 0.55 | — | — | — | 0.5 | — | 0.49 | 4.35 | 2.1 | 895 | 365 | 535 | C |
| 20 | 0.22 | 2.0 | 0.00 | 0 | — | — | — | 1.04 | — | 0.00 | 0.00 | 2.0 | 785 | 378 | 530 | C |
| 21 | 0.22 | 2.0 | 1.02 | 0 | — | — | — | 1.07 | — | 0.50 | 4.64 | 2.0 | 834 | 364 | 501 | C |
| 22 | 0.25 | 2.1 | 1.49 | 0.03 | — | — | — | — | — | 0.73 | 5.96 | 2.1 | 866 | 354 | 552 | C |
| 23 | 0.26 | 2.1 | 1.51 | 0.03 | 0.2 | — | — | — | — | 0.72 | 5.81 | 2.1 | 863 | 348 | 545 | C |
| 24 | 0.22 | 1.90 | 0.90 | 0.02 | — | — | — | 0.1 | — | 0.47 | 4.09 | 1.9 | 848 | 379 | 580 | I |
| 25 | 0.21 | 1.85 | 0.85 | 0.02 | — | — | — | 0.3 | — | 0.46 | 4.05 | 1.9 | 847 | 384 | 574 | I |
| 26 | 0.20 | 1.85 | 0.85 | 0.02 | — | — | — | — | 0.1 | 0.46 | 4.25 | 1.9 | 856 | 391 | 590 | I |
| 27 | 0.20 | 1.85 | 0.85 | 0.02 | — | — | — | — | 0.2 | 0.46 | 4.25 | 1.9 | 855 | 390 | 582 | I |
| 28 | 0.20 | 1.85 | 0.85 | 0.02 | — | — | — | 0.15 | 0.1 | 0.46 | 4.25 | 1.9 | 854 | 389 | 580 | I |
| 29 | 0.29 | 2.39 | 1.76 | — | — | — | — | — | — | 0.74 | 6.07 | 2.4 | 858 | 323 | 507 | C |

C = comparative example,

I = according to the invention

TABLE 3

| Alloy | Example | T1 ° C. | T2 ° C. | T3 ° C. | T4 ° C. | Temper Mill % | Rp MPa | Rm MPa | Ag MPa | Rp Temper Rolled MPa | Rm Temper Rolled MPa | Ag Temper Rolled MPa | I/C |
|---|---|---|---|---|---|---|---|---|---|---|---|---|---|
| 1 | A | 785 | 680 | 470 | 470 | 0 | 476 | 1038 | 12.0 | | | | C |
| | B | 810 | 680 | 470 | 470 | 0 | 572 | 988 | 11.6 | | | | C |
| 2 | A | 795 | 680 | 470 | 470 | 0 | 446 | 1007 | 14.1 | | | | C |
| | B | 820 | 680 | 470 | 470 | 0 | 579 | 989 | 12.2 | | | | I |
| | C | 795 | 650 | 470 | 470 | 0 | 474 | 1061 | 13.9 | | | | C |
| | D | 820 | 650 | 470 | 470 | 0 | 526 | 978 | 13.9 | | | | I |
| 3 | A | 805 | 680 | 470 | 470 | 0 | 433 | 998 | 13.8 | | | | |
| | B | 830 | 680 | 470 | 470 | 0 | 527 | 991 | 13.5 | | | | I |
| | C | 805 | 650 | 470 | 470 | 0 | 443 | 1000 | 14.8 | | | | C |
| | D | 830 | 650 | 470 | 470 | 0 | 565 | 988 | 13.5 | | | | I |
| 4 | A | 850 | 680 | 470 | 470 | 0 | 576 | 962 | 12.6 | — | — | — | I |
| | B | 790 | 680 | 470 | 470 | 0 | 407 | 951 | 17.5 | — | — | — | C |
| | C | 810 | 680 | 470 | 470 | 0 | 437 | 954 | 14.2 | — | — | — | C |
| | D | 810 | 680 | 440 | 470 | 0 | 420 | 945 | 17.4 | — | — | — | C |
| 5 | A | 795 | 680 | 470 | 470 | 0 | 420 | 982 | 13.5 | — | — | — | C |
| | B | 815 | 680 | 470 | 470 | 0 | 399 | 971 | 15.4 | — | — | — | C |
| | C | 815 | 680 | 440 | 470 | 0 | 416 | 960 | 15.9 | — | — | — | C |
| | D | 855 | 680 | 470 | 470 | 0 | 506 | 966 | 13.3 | — | — | — | I |
| | E | 855 | 680 | 440 | 470 | 0 | 551 | 982 | 12.3 | — | — | — | I |
| 6 | A | 800 | 680 | 470 | 470 | 0 | 392 | 980 | 15.8 | — | — | — | C |
| | B | 820 | 680 | 470 | 470 | 0 | 429 | 1033 | 13.3 | — | — | — | C |
| | C | 860 | 680 | 470 | 470 | 0 | 565 | 1049 | 13.1 | — | — | — | C |
| 7 | A | 835 | 680 | 470 | 420 | 0 | 530 | 997 | 14.6 | — | — | — | I |
| | C | 795 | 680 | 470 | 470 | 0 | 424 | 1047 | 14.3 | — | — | — | C |
| | C | 810 | 680 | 350 | 350 | 0 | 633 | 1091 | 10.9 | — | — | — | C |
| 8 | A | 860 | 640 | 470 | 470 | 0 | 515 | 1038 | 13.6 | — | — | — | I |
| | B | 835 | 670 | 470 | 470 | 0 | 511 | 1040 | 13.7 | — | — | — | I |
| | C | 835 | 610 | 470 | 470 | 0 | 481 | 1068 | 13.1 | — | — | — | C |
| 9 | A | 810 | 680 | 470 | 470 | 0.3 | 414 | 983 | 14.6 | 519.0 | 998.0 | 13.5 | I |
| 10 | A | 790 | 720 | 350 | 420 | 0 | 383 | 887 | 17.1 | — | — | — | C |
| | B | 820 | 720 | 350 | 420 | 0 | 401 | 889 | 20.0 | — | — | — | C |
| | C | 850 | 720 | 350 | 420 | 0 | 386 | 866 | 19.4 | — | — | — | C |
| | D | 850 | 720 | 300 | 420 | 0 | 424 | 845 | 21.8 | — | — | — | C |
| | E | 850 | 720 | 400 | 420 | 0 | 415 | 855 | 20.5 | — | — | — | C |
| 11 | C | 820 | 720 | 350 | 420 | 0 | 379 | 776 | 21.1 | — | — | — | C |
| | D | 850 | 720 | 350 | 420 | 0 | 352 | 776 | 20.7 | — | — | — | C |
| | E | 850 | 720 | 400 | 420 | 0 | 370 | 763 | 23.1 | — | — | — | C |
| 12 | A | 830 | 730 | 470 | 470 | 0 | 460 | 998 | 11 | — | — | — | C |
| | B | 880 | 730 | 470 | 470 | 0 | 502 | 998 | 10 | — | — | — | C |
| 13 | A | 830 | 730 | 470 | 470 | 0 | 390 | 772 | 22 | — | — | — | C |
| | B | 880 | 730 | 470 | 470 | 0 | 367 | 749 | 10 | — | — | — | C |
| 14 | A | 840 | 680 | 455 | 470 | 0 | 576 | 1021 | 13.4 | — | — | — | I |
| | B | 835 | 660 | 425 | 470 | 0 | 521 | 1040 | 13.2 | — | — | — | I |
| | C | 840 | 700 | 440 | 470 | 0 | 637 | 1004 | 11.3 | — | — | — | C |
| | D | 785 | 680 | 470 | 470 | 0 | 400 | 1033 | 13.7 | — | — | — | C |
| | E | 805 | 680 | 470 | 470 | 0 | 431 | 1068 | 14.5 | — | — | — | C |
| | F | 845 | 680 | 470 | 470 | 0 | 571 | 988 | 12.5 | — | — | — | I |
| | G | 805 | 680 | 440 | 470 | 0 | 421 | 998 | 15.7 | — | — | — | C |
| | H | 825 | 680 | 440 | 470 | 0 | 522 | 993 | 14.7 | — | — | — | I |
| | I | 845 | 680 | 440 | 470 | 0 | 578 | 994 | 14.4 | — | — | — | I |
| | J | 805 | 680 | 470 | 470 | 0 | 443 | 1054 | 11.7 | — | — | — | C |
| | K | 845 | 680 | 470 | 470 | 0 | 518 | 1010 | 12.6 | — | — | — | C |
| 15 | A | 845 | 680 | 440 | 470 | 0 | 623 | 993 | 12.3 | — | — | — | I |
| | B | 800 | 680 | 440 | 470 | 0 | 446 | 986 | 14.6 | — | — | — | C |
| | C | 800 | 680 | 440 | 470 | 0 | 436 | 987 | 14.4 | — | — | — | C |
| | D | 845 | 680 | 460 | 470 | 0 | 542 | 971 | 14.4 | — | — | — | I |
| | E | 845 | 680 | 420 | 470 | 0 | 598 | 988 | 13.0 | — | — | — | I |
| | F | 845 | 680 | 440 | 470 | 0 | 552 | 962 | 13.2 | — | — | — | I |
| | G | 845 | 700 | 440 | 470 | 0 | 605 | 956 | 12.2 | — | — | — | C |
| | H | 845 | 700 | 400 | 470 | 0 | 742 | 1026 | 9.3 | — | — | — | C |
| | I | 845 | 700 | 425 | 470 | 0 | 669 | 978 | 10.7 | — | — | — | C |
| | J | 845 | 700 | 450 | 470 | 0 | 619 | 964 | 11.7 | — | — | — | C |
| | K | 855 | 700 | 270 | 470 | 0 | 956 | 1091 | 7.7 | — | — | — | C |
| | L | 855 | 700 | 320 | 470 | 0 | 939 | 1079 | 7.8 | — | — | — | C |
| | M | 850 | 750 | 280 | 280 | 0 | 897 | 1384 | 5.6 | — | — | — | C |
| | N | 850 | 750 | 370 | 370 | 0 | 965 | 1184 | 4.3 | — | — | — | C |
| | O | 850 | 750 | 410 | 410 | 0 | 834 | 1011 | 7.1 | — | — | — | C |
| | P | 800 | 750 | 390 | 390 | 0 | 498 | 902 | 15.3 | — | — | — | C |
| | Q | 853 | 670 | 430 | 455 | 0.2 | — | — | — | 594 | 982 | 12.8 | I |
| | R | 841 | 678 | 427 | 455 | 0.2 | — | — | — | 581 | 996 | 12.3 | I |
| 16 | A | 840 | 680 | 470 | 470 | 0 | 889 | 1512 | 6 | — | — | — | C |
| | B | 810 | 680 | 470 | 470 | 0 | 665 | 1414 | 7 | — | — | — | C |
| | C | 810 | 680 | 420 | 420 | 0 | 867 | 1538 | 7 | — | — | — | C |

TABLE 3-continued

| Alloy | Example | T1 ° C. | T2 ° C. | T3 ° C. | T4 ° C. | Temper Mill % | Rp MPa | Rm MPa | Ag MPa | Rp Temper Rolled MPa | Rm Temper Rolled MPa | Ag Temper Rolled MPa | I/C |
|---|---|---|---|---|---|---|---|---|---|---|---|---|---|
| 17 | A | 830 | 680 | 470 | 470 | 0 | 842 | 1502 | 7 | — | — | — | C |
| | B | 860 | 680 | 470 | 470 | 0 | 837 | 1494 | 7 | — | — | — | C |
| | C | 830 | 680 | 420 | 420 | 0 | 740 | 1454 | 8 | — | — | — | C |
| 18 | A | 830 | 680 | 470 | 470 | 0 | 387 | 1000 | 14 | — | — | — | C |
| | B | 830 | 680 | 420 | 420 | 0 | 397 | 941 | 19 | — | — | — | C |
| | C | 860 | 680 | 470 | 470 | 0 | 407 | 1003 | 14 | — | — | — | C |
| 19 | A | 830 | 680 | 470 | 470 | 0 | 618 | 1330 | 9 | — | — | — | C |
| | B | 860 | 680 | 470 | 470 | 0 | 615 | 1311 | 8 | — | — | — | C |
| | C | 830 | 680 | 420 | 420 | 0 | 554 | 1240 | 11 | — | — | — | C |
| 20 | A | 730 | 680 | 470 | 470 | 0 | 520 | 946 | 4 | — | — | — | C |
| | B | 760 | 680 | 470 | 470 | 0 | 729 | 1378 | 7 | — | — | — | C |
| | C | 730 | 680 | 420 | 420 | 0 | 458 | 820 | 7 | — | — | — | C |
| 21 | A | 760 | 680 | 470 | 470 | 0 | 502 | 1053 | 6 | — | — | — | C |
| | B | 790 | 680 | 470 | 470 | 0 | 792 | 1479 | 7 | — | — | — | C |
| | C | 760 | 680 | 420 | 420 | 0 | 507 | 1042 | 6 | — | — | — | C |
| 22 | A | 845 | 600 | 400 | 420 | 0 | 543 | 1197 | 12 | — | — | — | C |
| | B | 845 | 600 | 470 | 470 | 0 | 508 | 1160 | 12 | — | — | — | C |
| | C | 845 | 680 | 470 | 470 | 0 | 512 | 1135 | 13 | — | — | — | C |
| 23 | A | 845 | 600 | 400 | 420 | 0 | 562 | 1278 | 12 | — | — | — | C |
| | B | 845 | 600 | 470 | 470 | 0 | 619 | 1335 | 9 | — | — | — | C |
| | C | 845 | 680 | 470 | 470 | 0 | 638 | 1350 | 10 | — | — | — | C |

C = comparative example,
I = according to the invention

TABLE 4

| Alloy | Example | T1 ° C. | T2 ° C. | T3 ° C. | T4 ° C. | Inter-critical Ferrite (%) | Retrans-formed Ferrite (%) | Bainite (%) | Austenite (%) | Martensite (%) | I/C |
|---|---|---|---|---|---|---|---|---|---|---|---|
| 3 | A | 855 | 680 | 450 | 450 | 0 | 12 | 69 | 11 | 8 | I |
| | B | 835 | 680 | 450 | 450 | 0 | 25 | 55 | 12 | 8 | I |
| | C | 785 | 680 | 450 | 450 | 30 | 31 | 19 | 15 | 5 | C |
| | D | 845 | 750 | 450 | 450 | 0 | 7 | 74 | 12 | 7 | C |
| | E | 845 | 680 | 370 | 370 | 0 | 15 | 73 | 6 | 6 | C |
| 24 | A | 855 | 680 | 450 | 450 | 0 | 37 | 46 | 10 | 7 | I |
| | B | 785 | 680 | 450 | 450 | 36 | 41 | 9 | 9 | 5 | C |
| | C | 845 | 680 | 370 | 370 | 0 | 40 | 47 | 8 | 5 | C |
| 25 | A | 855 | 680 | 450 | 450 | 0 | 16 | 69 | 7 | 8 | I |
| | B | 835 | 680 | 450 | 450 | 0 | 21 | 63 | 8 | 8 | I |
| | C | 785 | 680 | 450 | 450 | 41 | 22 | 14 | 6 | 17 | C |
| | D | 845 | 750 | 450 | 450 | 0 | 5 | 80 | 9 | 6 | C |
| | E | 845 | 680 | 370 | 370 | 0 | 14 | 74 | 5 | 7 | C |
| 26 | A | 855 | 680 | 450 | 450 | 0 | 21 | 61 | 10 | 8 | I |
| | B | 835 | 680 | 450 | 450 | 0 | 30 | 51 | 12 | 7 | I |
| | C | 785 | 680 | 450 | 450 | 39 | 25 | 18 | 12 | 6 | C |
| | D | 845 | 750 | 450 | 450 | 0 | 13 | 73 | 9 | 5 | C |
| | E | 845 | 680 | 370 | 370 | 0 | 21 | 66 | 7 | 6 | C |
| 27 | A | 855 | 680 | 450 | 450 | 0 | 14 | 66 | 11 | 9 | I |
| | B | 835 | 680 | 450 | 450 | 0 | 20 | 61 | 12 | 7 | I |
| | C | 785 | 680 | 450 | 450 | 44 | 19 | 17 | 4 | 16 | C |
| | D | 845 | 750 | 450 | 450 | 0 | 9 | 79 | 8 | 4 | C |
| | E | 845 | 680 | 370 | 370 | 0 | 13 | 74 | 8 | 5 | C |
| 28 | A | 855 | 680 | 450 | 450 | 0 | 14 | 69 | 10 | 7 | I |
| | B | 835 | 680 | 450 | 450 | 0 | 24 | 58 | 9 | 9 | I |
| | C | 785 | 680 | 450 | 450 | 41 | 28 | 16 | 7 | 8 | C |
| | D | 845 | 750 | 450 | 450 | 0 | 10 | 75 | 9 | 6 | C |
| | E | 845 | 680 | 370 | 370 | 0 | 18 | 73 | 5 | 4 | C |

C = comparative example,
I = according to the invention

TABLE 5

| Alloy | Preox | Mn wt % | Si Wt % | Si/ Mn | Coating Observations Wetting | Adhesion | I/C | Comment |
|---|---|---|---|---|---|---|---|---|
| 1 | No | 2.4 | 0.6 | 0.26 | ok | ok | C | Meets coating criteria. |
| | Yes | | | | ok | ok | C | Comparative becuase fails on properties |

TABLE 5-continued

| Alloy | Preox | Mn wt % | Si Wt % | Si/Mn | Coating Observations Wetting | Adhesion | I/C | Comment |
|---|---|---|---|---|---|---|---|---|
| 2 | No | 2.3 | 0.8 | 0.35 | ok | ok | I | Fully inventive example: |
| | Yes | | | | ok | ok | I | meets coating criteria with or without pre-oxidation |
| 3 | No | 2.1 | 1.0 | 0.48 | ok | ok | I | Fully inventive example: |
| | Yes | | | | ok | ok | I | meets coating criteria with or without pre-oxidation |
| 10 | No | 1.7 | 1.5 | 0.93 | Poor | — | C | Exceeds permissable Si |
| 12 | No | 1.5 | 1.4 | 0.93 | Poor | — | C | content and Si/Mn ratio |
| 13 | No | 1.5 | 1.4 | 0.93 | Poor | — | C | |
| 29 | No | 2.39 | 1.8 | 0.74 | Very Poor | poor | C | Exceeds permissable Si |
| | Yes | | | | ok | poor | C | content and Si/Mn ratio. Pre-oxidation aids wetability but not adhesion. |

C = comparative example,
I = according to the invention

The invention claimed is:

1. A steel strip having a hot dip zinc based coating, the steel strip having the following composition, in weight %:

C: 0.21-0.24
Mn: 1.8-2.5
Si: 0.65 to less than 1.2
Al: ≤0.3
optionally at least one member of the group consisting of Nb: ≤0.1, V: ≤0.3, Ti: ≤0.15, Cr: ≤0.5, and Mo: ≤0.3,
the remainder being iron and unavoidable impurities,
with a Si/Mn ratio ≤0.5 and a Si/C ratio ≥3.0,
with an Mn equivalent ME of at most 3.5, wherein ME=Mn+Cr+2 Mo (in wt. %) having a microstructure with (in vol. %):
ferrite: 0-40
bainite: 20-70
martensite: 7-30
retained austenite: 5-20
pearlite: ≤2
cementite: ≤1
having a tensile strength in the range of 960-1100 MPa, a yield strength of at least 500 MPa, and a uniform elongation of at least 12%.

2. The steel strip according to claim 1, wherein C: 0.21-0.22 wt. %.

3. The steel strip according to claim 1, wherein Si: 0.8-1.04 wt. %.

4. The steel strip according to claim 3, wherein the level of C is 0.21-0.22 wt. %.

5. The steel strip according to claim 1, wherein Si/C ratio ≥4.0.

6. The steel strip according to claim 1, wherein the zinc based coating is a galvanised or galvannealed coating.

7. The steel strip according to claim 1, wherein the zinc based coating is a coating containing 0.5-3.8 wt. % Al, 0.5-3.0 wt % Mg, optionally at most 0.2% of one or more additional elements selected from the group of Pb, Sb, Ti, Ca, Mn, Sn, La, Ce, Cr, Ni, Zr and Bi the balance being zinc and unavoidable impurities.

8. The steel strip according to claim 1, wherein element Nb is present in an amount of 0.01-0.04 wt. %.

9. The steel strip according to claim 1, wherein the steel strip comprises at least one member of the group consisting of Nb: ≤0.1, V: ≤0.3, Ti: ≤0.15, Cr: ≤0.5, and Mo: ≤0.3.

10. The steel strip according to claim 1, wherein Si: 0.65-1.0 wt. %.

11. The steel strip according to claim 1, wherein the level of V is 0.07<V≤0.3 wt. %.

12. The steel strip according to claim 1, wherein the level of Mo is 0.1-0.3 wt. %.

13. The steel strip according to claim 1, having a thickness of 1 mm.

14. The steel strip according to claim 1, wherein Si: 1.01 to less than 1.2 wt. %.

15. The steel strip according to claim 1, wherein Si: 1.04 to less than 1.2 wt. %.

16. A method for producing a high strength hot dipped zinc coated steel strip of claim 1 in a continuous way, comprising the following steps:

1) providing a steel strip having the following composition in wt. %:
C: 0.21-0.24
Mn: 1.8-2.5
Si: 0.65 to less than 1.2
Al: ≤0.3
optionally at least one member of the group consisting of Nb: ≤0.1, V: ≤0.3, Ti: ≤0.15, Cr: ≤0.5, and Mo: ≤0.3
the remainder being iron and unavoidable impurities,
with a Si/Mn ratio ≤0.5 and a Si/C ratio ≥3.0,
with an Mn equivalent ME of at most 3.5, wherein ME=Mn+Cr+2 Mo (in wt. %);
2) heating the strip to a temperature T1 (in ° C.) in the range of (Ac3+20)-(Ac3−30) to form a fully or partially austenitic microstructure;
3) slow cooling of the strip with a cooling rate in the range of 2-4° C./s to a temperature T2 in the range of 620-680° C.;
4) rapid cooling of the strip with a cooling rate in the range of 25-50° C./s to a temperature T3 (in ° C.) in the range of (Ms−20)-(Ms+100);
5) keeping the strip at a hold or slow cool temperature T4 in the range of 420-550° C. for a time period of 30-220 seconds;
6) hot dip coating the steel strip in a zinc bath to provide the strip with a zinc based coating;
7) cooling the coated steel strip at a cooling rate of at least 5° C./s to a temperature below 300° C.;

the cooled coated steel strip having a microstructure with (in vol. %):
ferrite: 0-40
bainite: 20-70
martensite: 7-30 retained austenite: 5-20 pearlite: less than or equal to 2 cementite: less than or equal to 1, and the cooled coated steel strip having a tensile strength in the range of 960-1100 MPa, a yield strength of at least 500 MPa, and a uniform elongation of at least 12%.

17. The method according to claim 16, wherein the hold or slow cool temperature T4 is in the range of 440-480° C.

18. The method according to claim 16, wherein in step 5) the temperature variation is ±20° C.

19. The method according to claim 16, wherein in step 5) the time period is in the range of 30-80 seconds.

20. The method according to claim 16, wherein in step 6) the steel strip temperature upon entry into the zinc bath is at most 30° C. above the bath temperature.

* * * * *